US007387060B1

(12) United States Patent
Sanford

(10) Patent No.: US 7,387,060 B1
(45) Date of Patent: Jun. 17, 2008

(54) ROCKET EXHAUST DEFENSE SYSTEM AND METHOD

(75) Inventor: Matthew J. Sanford, Bel Alton, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 248 days.

(21) Appl. No.: 11/134,595

(22) Filed: May 17, 2005

(51) Int. Cl.
*F41H 9/04* (2006.01)
*F41H 5/007* (2006.01)

(52) U.S. Cl. ..... 89/1.11; 89/36.17

(58) Field of Classification Search ..... 89/1.11, 89/1.1, 36.02, 36.08, 36.17
See application file for complete search history.

(56) References Cited

U.S. PATENT DOCUMENTS 3,998,406 A * 12/1976 Smith et al. ..... 244/3.14
4,607,849 A * 8/1986 Smith et al. ..... 273/348.1
4,869,152 A * 9/1989 Marlow et al. ..... 89/36.17
4,925,129 A * 5/1990 Salkeld et al. ..... 244/3.11
4,944,211 A 7/1990 Rowan et al.
5,020,411 A 6/1991 Rowan
5,025,707 A * 6/1991 Gonzalez ..... 89/36.17
5,050,818 A * 9/1991 Sundermeyer ..... 244/3.15
5,458,041 A * 10/1995 Sun et al. ..... 89/1.11
5,464,174 A * 11/1995 Laures ..... 244/3.11
5,747,665 A * 5/1998 Thompson ..... 44/265
5,866,840 A * 2/1999 Briere et al. ..... 102/336
6,012,375 A * 1/2000 Eckstein ..... 89/1.816
6,209,820 B1 * 4/2001 Golan et al. ..... 244/3.15
6,244,156 B1 * 6/2001 Steuer et al. ..... 89/1.11
6,318,273 B1 11/2001 Renaud-Bezot et al.
6,327,955 B1 * 12/2001 Kerdraon et al. ..... 89/36.17
6,352,031 B1 * 3/2002 Barbaccia ..... 102/365
6,717,543 B2 * 4/2004 Pappert et al. ..... 342/13
6,720,907 B1 * 4/2004 Miron ..... 342/52
6,738,012 B1 * 5/2004 Kirkpatrick ..... 342/67
6,825,792 B1 * 11/2004 Letovsky ..... 342/14
7,046,187 B2 * 5/2006 Fullerton et al. ..... 342/54
7,104,496 B2 * 9/2006 Chang ..... 244/3.19
7,138,936 B2 * 11/2006 Duff et al. ..... 342/14
2003/0024617 A1 * 2/2003 Reed et al. ..... 149/19.4
2004/0050239 A1 * 3/2004 Benyami et al. ..... 89/36.17
2004/0056792 A1 * 3/2004 Miron ..... 342/52
2006/0086243 A1 * 4/2006 Seo et al. ..... 89/36.17

* cited by examiner

*Primary Examiner*—Michael J. Carone
*Assistant Examiner*—Benjamin P Lee
(74) *Attorney, Agent, or Firm*—Fredric J. Zimmerman

(57) ABSTRACT

A projectile defense system uses a rocket exhaust generator to generate a rocket exhaust after an approaching projectile is detected/sensed. The rocket exhaust generator directs the rocket exhaust therefrom in a region that intercepts the trajectory of the approaching projectile.

26 Claims, 2 Drawing Sheets

ROCKET EXHAUST DEFENSE SYSTEM AND METHOD

STATEMENT OF GOVERNMENT STATEMENT

The invention described herein may be manufactured and used by or for the Government of the United States of America for government purposes without the payment of any royalties therefor.

FIELD OF THE INVENTION

The invention relates generally to defense systems and methods for defending a location. More particularly, the invention is a system and method for defending a location against an incoming projectile using a rocket exhaust.

BACKGROUND OF THE INVENTION

In a variety of world conflicts today, vehicles and structures are vulnerable to attack from inexpensive shoulder-launched projectiles/munitions such as rocket-propelled grenades (RPGs) and their variants. Propulsion for these projectiles/munitions is typically generated by either rocket motors or Davis-guns. Some have sustainer rockets to maintain or enhance flight velocity. Many have multiple warhead options designed for various threats. The most common types of warheads are shape-charge based anti-armor warheads for attacking tanks and armored vehicles, dual mode warheads for bunkers and lightly armored vehicles, thermobaric warheads for buildings and confined spaces, and some sophisticated threats containing shape charges and fragmenting grenades. Most are designed to impact the target at speeds ranging from 400-1200 feet per second. They have effective ranges from 50-600 meters depending on the system and projectiles used.

A passive defense strategy for RPGs involves the use of some type of armor attached to a vehicle or other target to be protected. Unfortunately, turning every vehicle into an improvised tank (or structure into a fortress) is not practical or cost effective. An example of an active defense strategy for RPGs is a reduced-size missile system. For example, one anti-missile system uses radar to detect and locate incoming missiles, and then aims and fires a rapid machine gun burst at the missile threat. However, this type of system can be expensive since it must possess precise target acquisition and aiming capabilities. Furthermore, this type of system can be a threat to friendly forces and noncombatants as any missed intercepts could result in bullets entering a nearby population.

Whether passive or active in nature, initiating an RPG (even at a distance) is not necessarily the optimal defeat mechanism. Ideally, the threat would be defeated without incurring a detonation event that generates the resulting jet and/or shrapnel associated with it in the vicinity of the target or nearby personnel.

SUMMARY OF THE INVENTION

Accordingly, it is an object of the present invention to provide a projectile defense system.

Another object of the present invention to provide a system and method for detecting the approach of an incoming and then deflecting or otherwise defeating the projectile so it does not impact the intended target.

Other objects and advantages of the present invention will become more obvious hereinafter in the specification and drawings.

In accordance with the present invention, a projectile defense system and method are provided. An approaching projectile and its trajectory are detected or sensed with a sensing system. A rocket exhaust generator coupled to the sensing system generates a rocket exhaust after the sensing system detects the approaching projectile. The rocket exhaust generator directs the rocket exhaust therefrom in a region that intercepts the trajectory of the approaching projectile to defeat the projectile.

BRIEF DESCRIPTION OF THE DRAWINGS

Other objects, features and advantages of the present invention will become apparent upon reference to the following description of the embodiments and to the drawings, wherein corresponding reference characters indicate corresponding parts throughout the several views of the drawings and wherein.

DETAILED DESCRIPTION OF THE INVENTION

Figure 1:
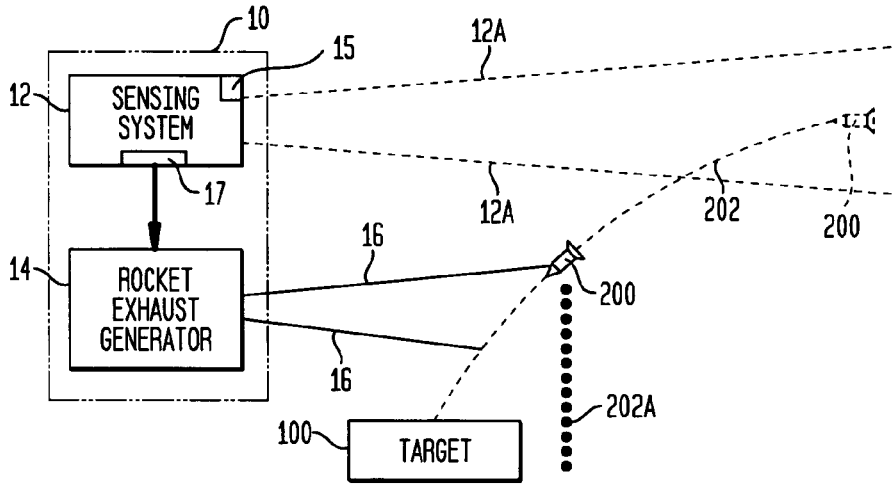
FIG. 1 is a schematic view of a projectile defense system configured to defeat an approaching projectile in accordance with the present invention.

Referring now to the drawings, and more particularly to FIG. 1, a projectile defense system in accordance with the present invention is contained within a dashed line box 10. Projectile defense system 10 can be used to defend a target 100 against a variety of incoming projectile threats such as projectile 200 which, for purposes of this example, is assumed to be traveling on a trajectory 202 that will cause it to impact target 100. It is to be understood that target 100 can be fixed in its location (i.e., a building, bridge, etc.) or could be a moving vehicle temporarily residing at or moving through a sensitive or protected location.

Defense system 10 includes a sensing system 12 and a rocket exhaust generator 14. The sensing system 12 and the rocket exhaust generator 14 are coupled together for purposes of communication between each other. Sensing system 12 is any system capable of detecting the approach of projectile 200, and predicting or determining trajectory 202 to see if projectile 200 is a threat to target 100. Generally, the sensing system 12 is designed to operate autonomously, that is, automatically without manual operation but could be operated manually if required. The sensing system 12 includes at least one sensor 15 and a processing unit 17, for example, a CPU, which is used, in part, to perform various functions (both not shown). In particular, the sensing system 12 has a processing capability for accomplishing one or more of the following tasks: detecting projectile 200, determining trajectory 202, determining velocity of projectile 200, predicting size of projectile 200, predicting distance that projectile 200 is from target 100, and other projectile parameters. In an exemplary embodiment, the processing unit 17 is configured so as to couple the sensing system 12 with the rocket exhaust generator 14 in order to provide communication between the sensing system 12, including the proximity sensor 15, and the rocket exhaust generator 14.

A variety of sensors 15 and, in particular, a proximity sensor 15 as part of the sensing system 12, is used without departing from the scope of the present invention. An example of one type of proximity sensor 15 is an ultra wideband radio-frequency ("rf") proximity sensor currently used on certain warheads in order to optimize the detonation point thereof. Another example of a proximity sensor 15 is a laser-based proximity sensor. For example, such sensors can be used individually, in combination or in an array depending on the application. Further, the sensors 15 could be adjustably configured to be directionally sensitive to incoming projectiles that are within a defined field-of-view, that is, a detection region, which in FIG. 1 lies between the two dashed lines referenced by numeral 12A.

Assuming sensing system 12 detected projectile 200 and determined that it was a threat to target 100 as calculated by the processing unit 17, then the processing unit 17 would send a signal to initiate the rocket exhaust generator 14. Once initiated, rocket exhaust generator 14 directs a rocket exhaust between lines 16, which defines an intercept area or region, such that trajectory 202 is intercepted as projectile 200 moves there through. An impulse provided by rocket exhaust 16 alters trajectory 202 so that projectile 200 assumes an alternate trajectory 202A that is offset from target 100. The amount of impulse provided by rocket exhaust 16 and an amount of time that such impulse is present are design choices predicated on a variety of factors, which include placement of rocket exhaust generator 14 relative to trajectory 202, type/size of projectiles that defense system 10 is expected to encounter as well as the size and/or monetary constraints that might be placed on defense system 10.

While it is most desirable to alter trajectory 202 as just described so that target 100 is not directly hit, it is to be understood that the presence of rocket exhaust 16 might also damage projectile 200 to prevent its detonation upon impact with target 100 or the surrounding environment (e.g., buildings, etc.), or cause projectile 200 to detonate prior to impacting target 100. In each of these cases, there may be some damage to target 100 although such damage would be far less than if target 100 were struck without projectile 200 encountering rocket exhaust 16.

Figure 2:
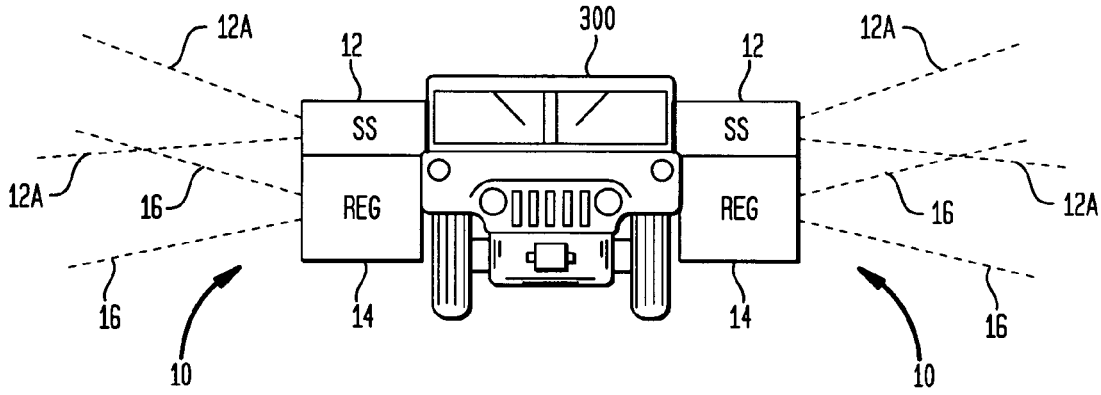
FIG. 2 is a schematic view of a projectile defense system of the present invention mounted on a vehicle.

Referring now to FIG. 2, the present invention is shown as it might be employed as a defensive system mounted on a moving vehicle 300. In the illustrated example, two of defense systems 10 are coupled to vehicle 300 with the field-of-view 12A associated with each one thereof being uniquely directed. It is to be understood that additional defense systems 10 could also be coupled to vehicle 300 without departing from the scope of the present invention. Each of defense systems 10 could be constructed with component elements being separately attached to vehicle 300. Another option would be for each defense system 10 to comprise a modular unit that is completely self-contained (i.e, sensing system ("SS") 12 and rocket exhaust generator ("REG") 14 are coupled together in a single package) and adapted to simply attach to and be removed from vehicle 300. Another option would be for each defense system 10 to be integrated to each other via the processing unit 17 and/or a second processing unit 19, for example, a CPU, to conduct activity and/or provide feedback to occupants of the vehicle 300 as well as coordination resources outside the vehicle 300, for example, by a satellite GPS link. Such attachment/detachment schemes are well understood in the art and are not limitations of the present invention. In this type of embodiment, since vehicle 300 represents the target to be protected, rocket exhaust generator 14 is configured such that rocket exhaust 16 (shown in dashed line form to indicate the location thereof when generator 14 is initiated) would be directed in a direction that could impart at least some degree of a side load to any approaching projectile detected by the defense system's corresponding sensing system 12.

Figure 3:
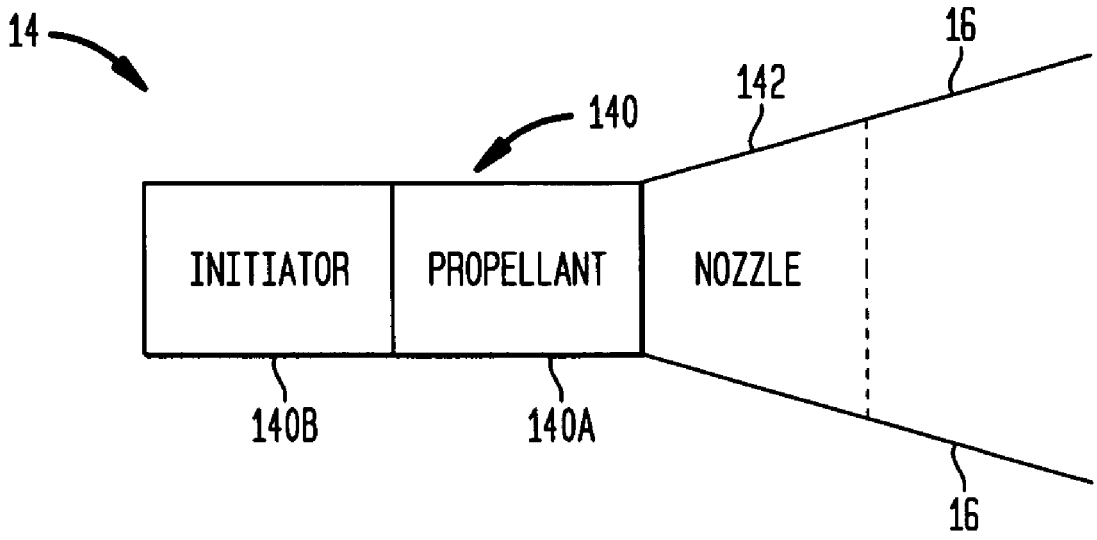
FIG. 3 is a schematic view of an embodiment of a rocket exhaust generator for use in the present invention.

In each of the above-described embodiments, rocket exhaust generator 14 is any device capable of directing rocket exhaust 16 into a region between an approaching projectile and a target to be protected. For example, FIG. 3 illustrates one such rocket exhaust generator 14 where a rocket motor 140 includes an exhaust nozzle 142 coupled thereto. Generally, the rocket motor 140 includes an inner portion 19 (not shown). Located in the inner portion 19 are a propellant 140A and an initiator 140B for starting the burning of propellant 140A. The gas produced by propellant 140A is exhausted as rocket exhaust 16 by exhaust nozzle 142.

Figure 4:
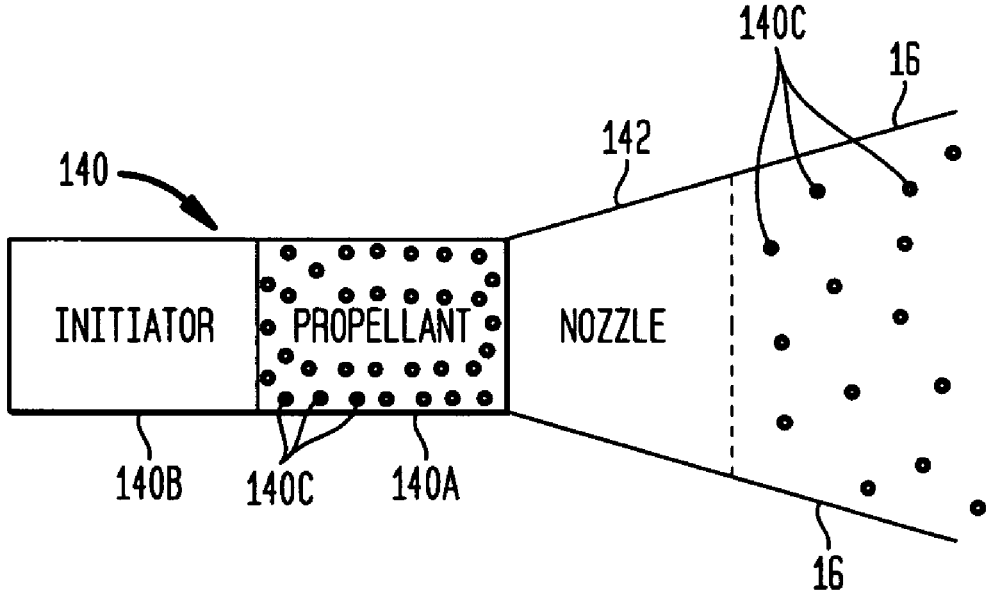
FIG. 4 is a schematic view of an embodiment of a rocket exhaust generator in which material particles are mixed in a propellant for ultimate inclusion in the rocket exhaust.

If conventional propellants are used in the present invention, rocket exhaust 16 comprises a gas that would be effective at defeating an approaching projectile at relatively short stand-off distances from a target. While advantageous in densely populated areas, the defensive capabilities of such a system may be less than what is required for certain types of hostile projectiles. To enhance the range and/or effectiveness of the present invention without substantially increasing the danger to the nearby population, the pre-burn form of the propellant could have material particles mixed therein where the material particles are selected to survive the burning of the propellant. In other words, the material particles should be a material that has a melting temperature that is greater than the burn temperature of the propellant in which it is mixed. Accordingly, FIG. 4 illustrates a rocket motor 140, which includes an inner portion 19 (not shown). Located in the inner portion 19 are a propellant 140A including material particles 140C mixed in the propellant 140A where it will be assumed that a melting temperature of particles 140C is greater than a burn temperature of propellant 140A. Upon initiation, propellant 140A burns while material particles 140C do not. As propellant 140A burns, particles 140C are released in a controlled manner and become fluidized in the turbulent fast moving gasses forming rocket exhaust 16 exiting nozzle 142. Accordingly, nozzle 142 should be designed for optimal acceleration of small particles in a gas as would be the case for high-efficiency sand blasting types of nozzles. As a result, rocket exhaust 16 includes the gas resulting from the burning of propellant 140A and material particles 140C dispersed therein.

Material particles 140C would generally include a powder with particle sizes generally falling in a predetermined range of about 1 to about 500 (about 1-about 500) microns in diameter. A variety of materials could be used for particles 140C. For example, a suitable material is tungsten, which is heavy, non-toxic, inexpensive, and has a high melting temperature (i.e., greater than 6000° F.). Due to substantial weight and density characteristics of the tungsten, tungsten when accelerated in a high-speed rocket exhaust will impart significant inertia to a projectile upon impact therewith.

A powder form of material particles 140C works well in the present invention because it can be spread (via rocket exhaust 16) to a relatively large region as compared to a single object such as a bullet. This means that the present invention does not need to possess expensive and complicated target acquisition capabilities (in sensing system 12) or aiming capabilities. Further, the high surface area-to-mass ratio presented by a dispersed powder means that material particles 140C will slow to a non-lethal velocity at a reasonable distance from their launch point thereby making the present invention reasonably safe even in densely populated regions.

The advantages of the present invention are numerous. The projectile defense system and method are simple and can be adapted for protection of a wide variety of targets to include vehicles. The rocket exhaust is capable of deflecting an incoming projectile while remaining substantially non-lethal to nearby personnel. By incorporating dense powder in the rocket exhaust, the effective range of the defense system is increased as are the forces that can be imparted to an approaching projectile.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A projectile defense system, comprising:

a sensing system for detecting an approaching projectile and its trajectory; and a rocket exhaust generator coupled to said sensing system for generating a rocket exhaust after said sensing system detects the approaching projectile, wherein said rocket exhaust generator is a land-based rocket exhaust generator that generates said exhaust while maintaining said land base, which includes an exhaust nozzle coupled to a rocket motor, where the exhaust nozzle directs said rocket exhaust, which includes at least gas, therefrom in a region that intercepts the trajectory of the approaching projectile.

2. The projectile defense system according to claim 1, wherein said sensing system comprises at least one proximity sensor.

3. The projectile defense system according to claim 1, wherein said rocket exhaust is a gas.

4. The projectile defense system according to claim 1, wherein said rocket exhaust is a mixture of a gas and material particles.

5. The projectile defense system according to claim 4, wherein said material particles comprise tungsten.

6. The projectile defense system according to claim 4, wherein said material particles are of a diameter in a predetermined range of about 1 micron-about 500 microns.

7. The projectile defense system according to claim 1, wherein said rocket motor burns a propellant to generate said rocket exhaust for expulsion through said exhaust nozzle.

8. The projectile defense system according to claim 7, further comprising material particles mixed in said propellant, said material particles having a melting temperature that is greater than a burn temperature of said propellant.

9. The projectile defense system according to claim 1, wherein said sensing system detects said approaching projectile in a defined detection region.

10. The projectile defense system according to claim 1, wherein said sensing system comprises at least one of an ultra wideband proximity sensor and a laser-based proximity sensor.

11. The projectile defense system according to claim 1, wherein said sensing system comprises a processing unit configured to communicate between said sensing system and said rocket exhaust generator.

12. A projectile defense system, comprising:

a proximity sensor for detecting when an approaching projectile could strike a target to be protected and for generating a signal indicative thereof;

a rocket motor comprising an inner portion and a propellant located in said inner portion, said rocket motor is coupled to said proximity sensor for initiating the burning of said propellant in response to said signal wherein gas is generated;

and an exhaust nozzle coupled to said rocket motor, which are part of a land-based rocket exhaust generator, for exhausting at least said gas therefrom in a region between the approaching projectile and the target to be protected;

wherein said rocket exhaust generator operates while maintaining said land based location.

13. The projectile defense system according to claim 12, wherein said proximity sensor comprises at least one ultra wideband proximity sensor.

14. The projectile defense system according to claim 12, further comprising material particles mixed in said propellant, said material particles having a melting temperature that is greater than a burn temperature of said propellant, wherein said exhaust nozzle exhausts said gas with said material particles mixed therein.

15. The projectile defense system according to claim 12, further comprising material particles mixed in said propellant, said material particles comprise tungsten.

16. The projectile defense system according to claim 15, wherein said material particles are of a diameter in a predetermined range of about 1 micron-about 500 microns.

17. The projectile defense system according to claim 12, wherein said proximity sensor, said rocket motor and said exhaust nozzle comprise a modular unit.

18. The projectile defense system according to claim 17, wherein said modular unit is adapted to be coupled to the target to be protected.

19. The projectile defense system according to claim 12, wherein said proximity sensor is operationally sensitive in a defined field-of-view.

20. The projectile defense system according to claim 12, further comprising a manual control coupled to said rocket motor for accepting a manual input that initiates the burning of said propellant.

21. The projectile defense system according to claim 12, her comprising a processing unit configured to communicate between said proximity sensor and said rocket motor.

22. A method for defending a land based location against an approaching projectile, comprising:

detecting an approaching projectile and its trajectory by a sensing system; and generating a rocket exhaust by a rocket exhaust generator being coupled to the sensing system where the rocket exhaust generator includes a rocket motor coupled to an exhaust nozzle, which directs at least the rocket exhaust into a region that intercepts the trajectory of the approaching projectile wherein said rocket exhaust generator operates while maintaining said land-based location.

23. The method according to claim 22, further comprising burning a propellant to produce a gas that forms said rocket exhaust.

24. The method according to claim 23, further comprising mixing material particles with said propellant prior to said step of burning, said material particles having a melting temperature that is greater that a burn temperature of said propellant, wherein said rocket exhaust comprises said gas with said material particles mixed therein.

25. The method according to claim 23, further comprising mixing material particles with said propellant prior to said step of burning, wherein said material particles comprise tungsten.

26. The method according to claim 22, wherein said detecting and said directing are carried out at a target to be protected.

* * * * *